US007385515B1

(12) United States Patent
Owen et al.

(10) Patent No.: US 7,385,515 B1
(45) Date of Patent: Jun. 10, 2008

(54) SURVEILLANCE DETECTION SYSTEM AND METHODS FOR DETECTING SURVEILLANCE OF AN INDIVIDUAL

(76) Inventors: William K. Owen, 2211 Cedar Cove Ct., Reston, VA (US) 20191; C. John Fitzgerald, 924 Constellation Dr., Great Falls, VA (US) 22066

( * ) Notice: Subject to any disclaimer, the term of this patent is extended or adjusted under 35 U.S.C. 154(b) by 169 days.

(21) Appl. No.: 11/420,175

(22) Filed: May 24, 2006

Related U.S. Application Data

(60) Provisional application No. 60/479,975, filed on Jun. 2, 2005.

(51) Int. Cl.
*G08B 23/00* (2006.01)

(52) U.S. Cl. ..... 340/573.1; 340/540; 340/573.4; 340/539.11; 340/539.23

(58) Field of Classification Search ..... 340/540, 340/573.4, 539.13, 539.11, 5.2, 506, 521, 340/932.2, 937, 933, 923, 574, 573.1, 531, 340/539.23, 539.15
See application file for complete search history.

(56) References Cited

U.S. PATENT DOCUMENTS

| | | | | |
|---|---|---|---|---|
| 5,229,601 | A | 7/1993 | Guern et al. | |
| 5,760,709 | A * | 6/1998 | Hayashi | 340/923 |
| 6,397,154 | B1 | 5/2002 | Jones et al. | |
| 6,856,249 | B2 * | 2/2005 | Strubbe et al. | 340/573.1 |
| 7,095,328 | B1 * | 8/2006 | Stern et al. | 340/573.1 |
| 7,119,674 | B2 * | 10/2006 | Sefton | 340/521 |
| 7,123,126 | B2 * | 10/2006 | Tanaka et al. | 340/5.2 |
| 2004/0225480 | A1 | 11/2004 | Dunham | |
| 2005/0281435 | A1 | 12/2005 | Aggarwal | |

OTHER PUBLICATIONS

Scott, Tony, "Surveillance Detection Program," 2000, Praesidia Defense.

Blue Eye Video, "Blue Guardian," 2004, Blue Eye Video.

Blue Eye Video, "Product Lines," 2004, Blue Eye Video.

Remington Elsag Law Enforcement Systems, LLC, 2006, pp. 1-4.

HSToday, Industry News, "Remington and Elsag Form Venture to Distribute License-Plate Reading Technology", Sep. 2004.

Ohio State Patrol Press Release, "Automatic Plate Recognition Evaluation Ends with Positive Results", Dec. 22, 2004.

Richard Winton"Spotting Car Thieves in Blink of Digital Eye", LA Times, Sep. 15, 2006, California Metro; Part B; Metro Desk.

Luke O'Brien, "License Plate Tracking for All", Wired News, Jul. 25, 2006.

* cited by examiner

*Primary Examiner*—Anh V La

(57) ABSTRACT

A system and processing techniques are provided for automatically detecting when an individual is under surveillance. At least one uniquely identifying characteristic associated with a vehicle or a person in proximity to the individual is detected as the individual moves about a geographic region, such as when the individual is traveling in a car. Positions in the geographic region where the uniquely identifying characteristics are collected and the times of these collections as the individual moves about the geographic region are also captured. Data is stored for detections of the uniquely identifying characteristics, times of detections and the positions where the uniquely identifying characteristics are detected as the individual moves about the geographic region. The stored data is analyzed to determine whether the individual is under surveillance based on (1) a match of the uniquely identifying characteristics with data stored in a database of known surveillance threats (vehicles, individuals or other characteristics) without regard to the time, distance and direction parameters associated with detection of those uniquely identifying characteristics, or (2) at least two detections of the same uniquely identifying characteristics sufficiently separated by time, distance and direction as said individual moves about said geographic region, or (3) based on either (1) or (2).

23 Claims, 8 Drawing Sheets

SURVEILLANCE DETECTION SYSTEM AND METHODS FOR DETECTING SURVEILLANCE OF AN INDIVIDUAL

RELATED APPLICATION

This application claims priority to U.S. Provisional Application No. 60/479,975, filed Jun. 2, 2005, the entirety of which is incorporated herein by reference.

BACKGROUND OF THE INVENTION

There are certain individuals who, because of their profession or their celebrity status, wish to know when and if they are subject to personal surveillance as they move about a geographic region. For example, certain public figures, businessmen, law enforcement officials, military personnel, intelligence officers and government officials stationed abroad, may become the target of a surveillance operation. The surveillance operation may be initiated by well-trained experienced individuals, terrorists, or by common criminals or from stalkers. Public figures, such as celebrities or elected officials, may face a kidnapping or stalker threat. In some areas of the world, business personnel constantly face threats posed by kidnappers, robbers, and/or terrorists. Law enforcement officials may face a threat from gang members, organized crime figures, narcotics traffickers, terrorists or common criminals. The threat level is particularly high, for law enforcement officers operating undercover, for those working with confidential informants and for law enforcement officials involved with individuals in a witness protection program. Military personnel and/or intelligence officers serving abroad in hostile locations are constantly as risk due to surveillance threats from local security services as well as terrorist and or criminal elements.

What is needed is a system that automatically monitors certain activity occurring around an individual as the individual moves about a geographic region or locality and alerts the individual when the activity confirms that the individual is under surveillance.

SUMMARY OF THE INVENTION

Briefly, a system and processing techniques are provided for automatically detecting when an individual is under surveillance. At least one uniquely identifying characteristic associated with a vehicle or a person in proximity to the individual is detected as the individual (user) moves about a geographic region, such as when the individual is traveling in a car or on foot. Positions in the geographic region where the uniquely identifying characteristics are detected and the times when the collections/detections are made are also captured as the individual moves about the geographic region. Data is stored for detections of the uniquely identifying characteristics, times of detections and the positions where the uniquely identifying characteristics are detected as the user moves about the geographic region. The stored data is analyzed to determine whether the individual is under surveillance based on (1) a match of the uniquely identifying characteristics with data stored in a database of known surveillance threats (vehicles, individuals or other characteristics) without regard to the time, distance and direction parameters associated with detection of those uniquely identifying characteristics; or (2) at least two detections of the same uniquely identifying characteristics sufficiently separated by time, distance and direction as said individual moves about said geographic region, or (3) based on either (1) or (2).

DETAILED DESCRIPTION

Figure 1:
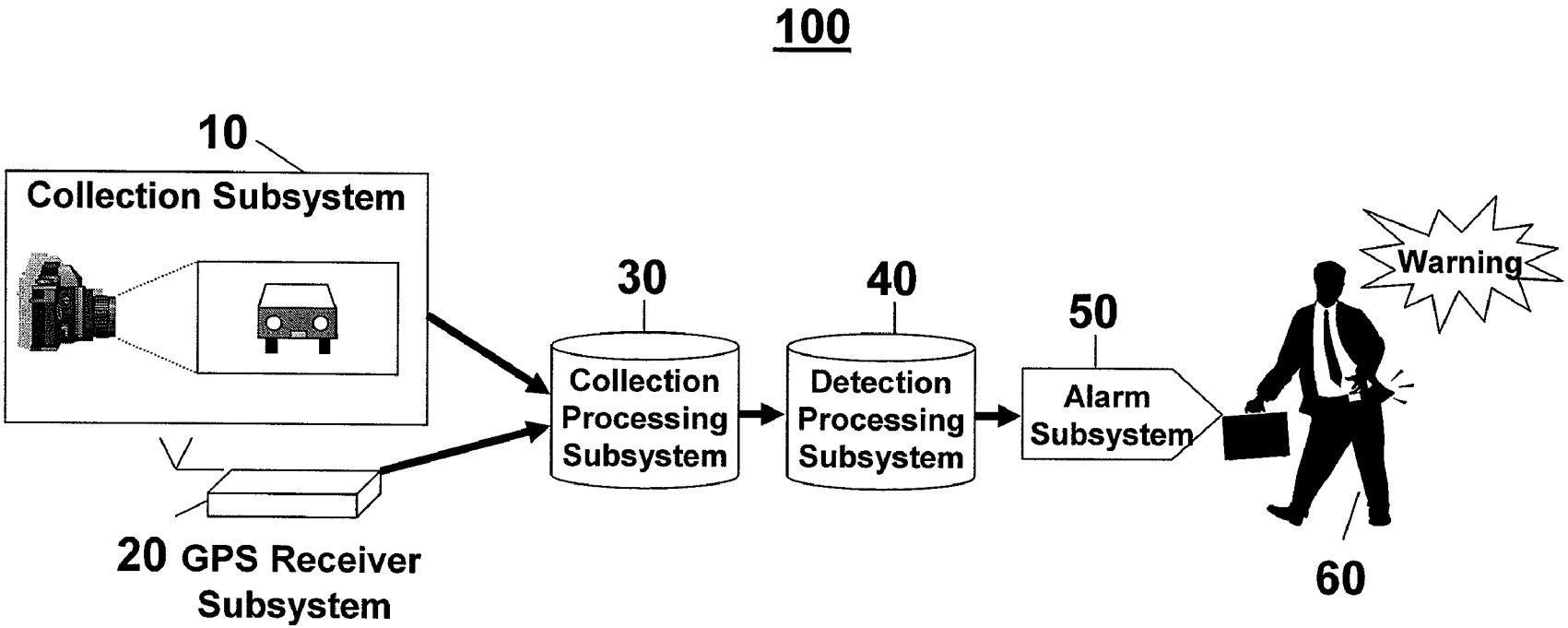
FIG. 1 is a block diagram of a surveillance detection system (SDS) according to an embodiment of the invention.

Referring first to FIG. 1, a high-level block diagram or overview of the surveillance detection system (SDS) 100 is described. The SDS 100 comprises several subsystems or components: a collection subsystem 10, a global positioning system (GPS) receiver subsystem 20, a collection processing subsystem 30, a detection processing subsystem 40, and an alarm subsystem 50.

Briefly, the collection subsystem 10 takes in target information or data through various collection sensors and tags the processed image with GPS location and time from the GPS receiver subsystem 20. FIG. 1 shows the collection subsystem 10 in one embodiment, in the form of a camera that takes still or moving (video) images of a vehicle, e.g., a car, as an example. Collected target information is analyzed/processed/filtered and converted to readable data and tagged with time, location and directional information by the collection processing subsystem 30. Algorithms stored in and executed by the detection processing subsystem 40 analyze the collected information to determine an individual's surveillance status. The alarm subsystem 50 is activated based on the outputs of the detection processing subsystem algorithms and warns the user 60 of potential threats.

Figure 2:
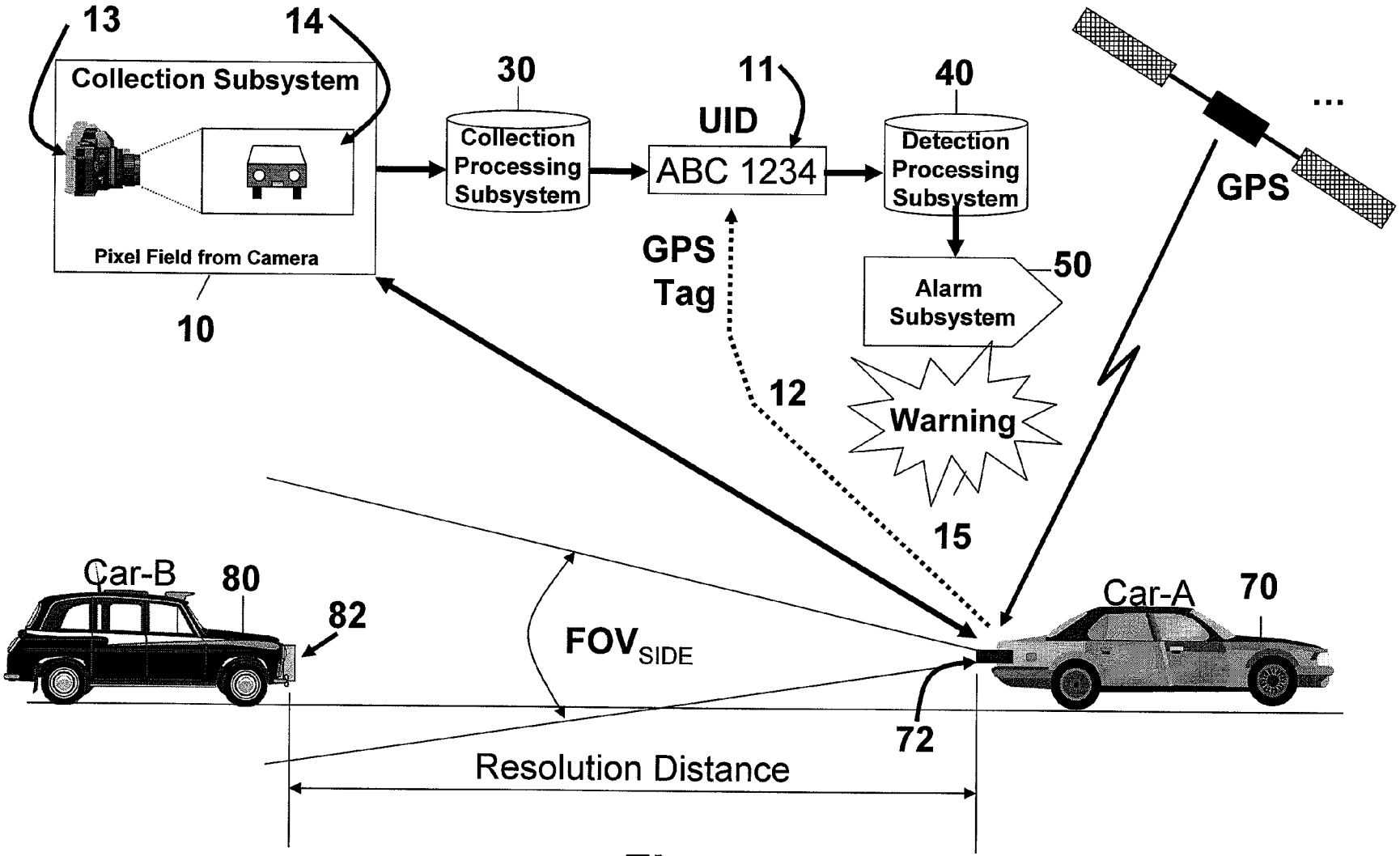
FIG. 2 is a block diagram generally showing an operational environment of the SDS according to an embodiment of the invention.

The particular configuration and operation of the SDS subsystems is dependent on the potential threat to the user. For example, if the user is going to be driving or walking, the threat could be other persons or one or more other vehicles surveilling him/her. To determine whether the individual is under surveillance, the collection subsystem 10 would have a sensor designed to pull unique information (unique identifier) during the users route. FIG. 2 depicts a scenario using a camera as the sensor in the collection subsystem 10. The collection subsystem 10 could be any one or more of a number of sensors designed to collect various types of target data such as facial recognition, electrical device emissions, mobile phone transmissions or other wireless device (e.g., radio frequency) emissions or transmission signal related identifiers, beacon emissions, signal shapes, physical object shapes, etc., as described further hereinafter in conjunction with FIG. 4. For practical reasons, the collection subsystem 10 may comprises a single a sensor, such as one of the sensors described below in connection with FIG. 4, but the present invention is not limited to a surveillance detection system or method employing a single sensor.

To better understand the operating premise for the SDS 100 according to an embodiment FIG. 2 illustrates a surveillance scenario using a camera as the collection subsystem 10. FIG. 2 shows Car-A 70 being surveilled by Car-B 80. Car-A 70 is equipped with the SDS 100. The SDS 100 can be modular between the components with communication/connectivity through standard commercial communication protocols or conventions (hard-wired, wireless, e.g., Bluetooth™, etc.). This embodiment shows the collection subsystem 10 installed in the rear of Car-A 70 shown at reference numeral 72, such as a vehicle taillight assembly, etc. The target unique identifier in this instance is the one or more alphanumeric characters on a license plate 82 of the potential threat, Car-B 80. The collection subsystem 10 in this example comprises a camera 13 designed to operate over a given field of view and with an appropriate digital resolution to allow a captured image 14 to be processed by the collection processing subsystem 30. The collection processing subsystem 30 analyzes the captured image 14 in order to located and interpret the combination of letters and/or numbers and other information on the license plate 82, such information being shown at reference numeral 11, and to output that data 11 to the detection processing subsystem 40. When the camera 13 captures the image, the GPS receiver 20 (FIG. 1), which can be integrated with the other subsystems or in a separate module, collects the location, time and direction of Car-A 70 and tags the image data with this geospatial information shown at reference numeral 12. This collection of information (license plate, location, time, and direction) is the unique identifier (UID) that is passed to the detection processing subsystem 40. Thus, the UID comprises a combination of the geospatial information or GPS tag with the data processed by the collection processing subsystem 30. The presence or existence of surveillance is confirmed in two ways.

1) Car-B 80 is spotted and registered over a significant change in time, a significant change in distance, and a significant change in direction. This technique is referred hereinafter as the Time, Distance, and Direction (TDD) analysis.

2) A database check where the license plate 82 of the vehicle trailing the user is checked against an on-board predetermined database that has been loaded with license plate data associated with known or suspected threats.

If a threat is determined from either method above, then a signal is sent to the alarm subsystem 50 that alerts the user with a warning 15 that surveillance has been detected. This warning 15 could alert the user by one or more methods that are described in more detail below. If the database check against known surveillance threats occurs for a particular collected uniquely identifying characteristic, then the declaration and alert of surveillance may be made immediately without waiting to determine if the conditions of the TDD analysis are met indicating that the individual is actually being followed.

Figure 3:
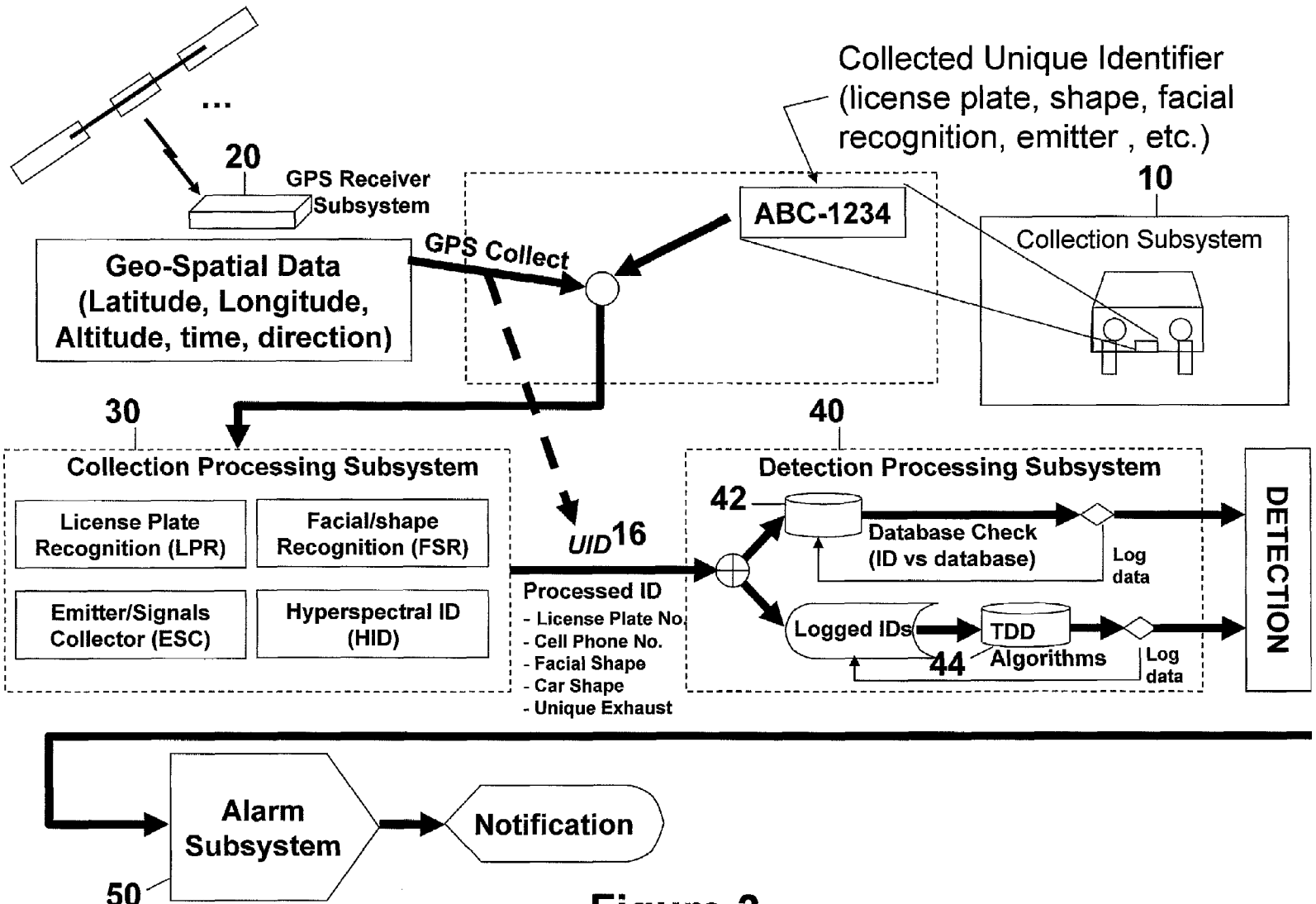
FIG. 3 is a more detailed block diagram of the SDS and showing information collection and processing flows according to an embodiment of the invention.

Turning to FIG. 3, a more comprehensive flow diagram is shown for the operation of the SDS 100 according to one embodiment. Details concerning each of the subsystems of the SDS 100 are described hereinafter in conjunction with FIGS. 4-8. The collection subsystem 10 captures unique environmental identifiers/information (license plate, car shape, exhausts, beacon emissions, mobile phone or radio frequency emissions, as described above and in further detail hereinafter) and tags such information with geospatial positioning information that the GPS receiver subsystem 20 produces when the collection subsystem 10 collects that information. Again, the collection processing subsystem 30 processes the positioning information and the information collected by the collection subsystem 10 to produce the UID shown at reference numeral 16. The detection processing subsystem 40 analyzes the UID 16 with each of two processes briefly mentioned above and shown at reference numerals 42 and 44. These processes are described in further detail in conjunction with FIG. 7.

Thus, not by way of limitation, one example of application of the SDS 100 is for use by an individual that travels a planned route to determine whether the data collected by the SDS 100 during the planned indicates that the individual is under surveillance.

Reference will now be made individually to FIGS. 4-8, taken in conjunction with FIGS. 1-3, for a more detailed description of each of the subsystem of the SDS 100 according to embodiments of the invention.

Figure 4:
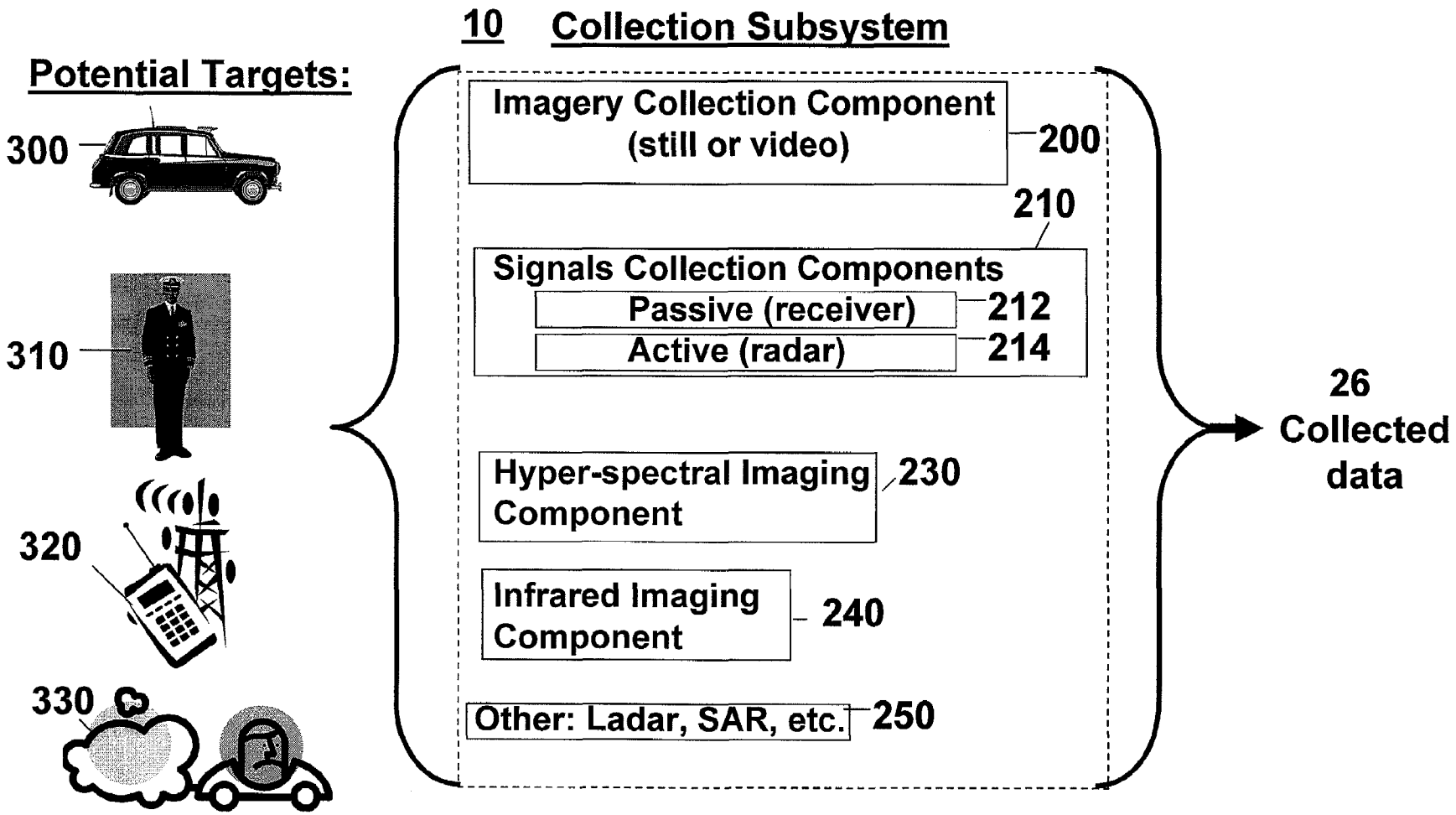
FIG. 4 is a diagram of the collection subsystem portion of the SDS showing, not by way of limitation, examples of sensors that may be used according to an embodiment of the invention.

FIG. 4 illustrates the collection subsystem 10 in greater detail according to an embodiment. The collection subsystem 10 comprises hardware and/or software necessary to capture information capable of sufficiently (and uniquely) identifying a potential threat with respect to a user. As mentioned above, the collection subsystem 10 may comprise, in one embodiment, an imagery collection component shown at reference numeral 200, such as a digital camera device capable of taking still and/or moving (video) images. The imagery collection component 200 may be useful to capture image data of any visible indicia associated with a potential threat surveillant. For example, unique visible indicia for a vehicle may comprise the vehicle's license plate, certain unique shapes associated with the vehicle, identifying or unique dents, color(s) of the vehicle, etc., collectively represented by reference numeral 300. In addition, unique visible indicia for a person may comprise facial shapes or other visibly recognizable characteristics that can be detected and analyzed, such as using facial recognition techniques, all of such visible indicia collectively represented by reference numeral 310.

The collection subsystem 10 may comprise, in addition, or instead, devices or equipment capable of receiving and capturing data related to received radio frequency (RF) energy emitted in the vicinity of the user to capture any unique RF signatures emitted by devices used by a threat. This is shown as the signals collection component 210. The signals collection component 210 may comprise a passive signal collection component 212, such as a scanning or wideband RF receiver and an active signal collection component 214. Reference numeral 320 represents the RF devices (wireless mobile cell phones, two-way wireless email devices, e.g., Blackberry™ devices, tracking beacons, etc) whose over-the-air signals or over-the-air RF power spectral characteristics (pulse center frequency, pulse bandwidth, pulse duration, power, signal communication protocol type, etc.) may be captured by the passive signal collection component 212 for generating uniquely identifying characteristics used in the SDS 100 as described herein. Furthermore, the passive signal collection component 212 may have the capability of demodulating and decoding a detected transmission from a wireless communication device such as a cell phone in order to extract a unique identifier (MAC address, IP address, international mobile subscriber identity-IMSI, temporary mobile subscriber identity-TMSI, etc.) associated with that communication device to serve as part of the entirety of a uniquely identifying characteristic. Similarly, the collection subsystem 10 may comprise an active signal collection component 214, such as a radar monitoring component or equipment that can capture image data pertaining to a potential threat target using radar techniques.

Further still, the collection subsystem 10 may comprise sensors or equipment capable of monitoring characteristics associated with a potential threat using remote spectroscopy techniques that involve emitting optical energy (e.g., Raman light) and capturing reflected or scattered optical energy that, when analyzed using spectroscopy techniques, can reveal data pertaining to the chemical make-up of any unique solid, liquid or gas chemical substance associated with a target, such as exhaust of a vehicle, shown at reference numeral 330. The equipment to perform this type of data gathering is referred to as a hyper-spectral imaging component and is shown at reference numeral 320, or more generally as remote spectroscopy monitoring equipment.

Another data gathering components that may be part of the collection subsystem are an infrared imaging component or equipment 240 that can capture thermal imagery information associated with a potential threat. Still further examples of data gathering components that may be included in the collection subsystem 10 are laser radar (LADAR) and synthetic aperture radar (SAR) components represented at reference numeral 250. SAR systems take advantage of the long-range propagation characteristics of radar signals and the complex information processing capability of modern digital electronics to provide high resolution imagery. Synthetic aperture radar complements photographic and other optical imaging capabilities because the minimum constraints on time-of-day and atmospheric conditions and because of the unique responses of terrain and cultural targets to radar frequencies. Further still, the collection subsystem 10 may include acoustic sensors capable or remotely monitoring sounds associated with a potential threat.

In sum, the collection subsystem 10 may comprise sensors that can monitor in real-time anything that can be detected with the senses of sight, sound, smell, as well as any other unique information associated with energy carried in the air or characteristics of matter (solid, liquid or gas) associated with a potential surveillant, that can be analyzed to create a unique signature of a potential surveillant. The components of the collection subsystem 10 may be designed or configured so that they can operate day or night an in a wide range of temperature, weather conditions and terrain. Reference numeral 26 represents the data collected by the collection subsystem 10.

Figure 5:
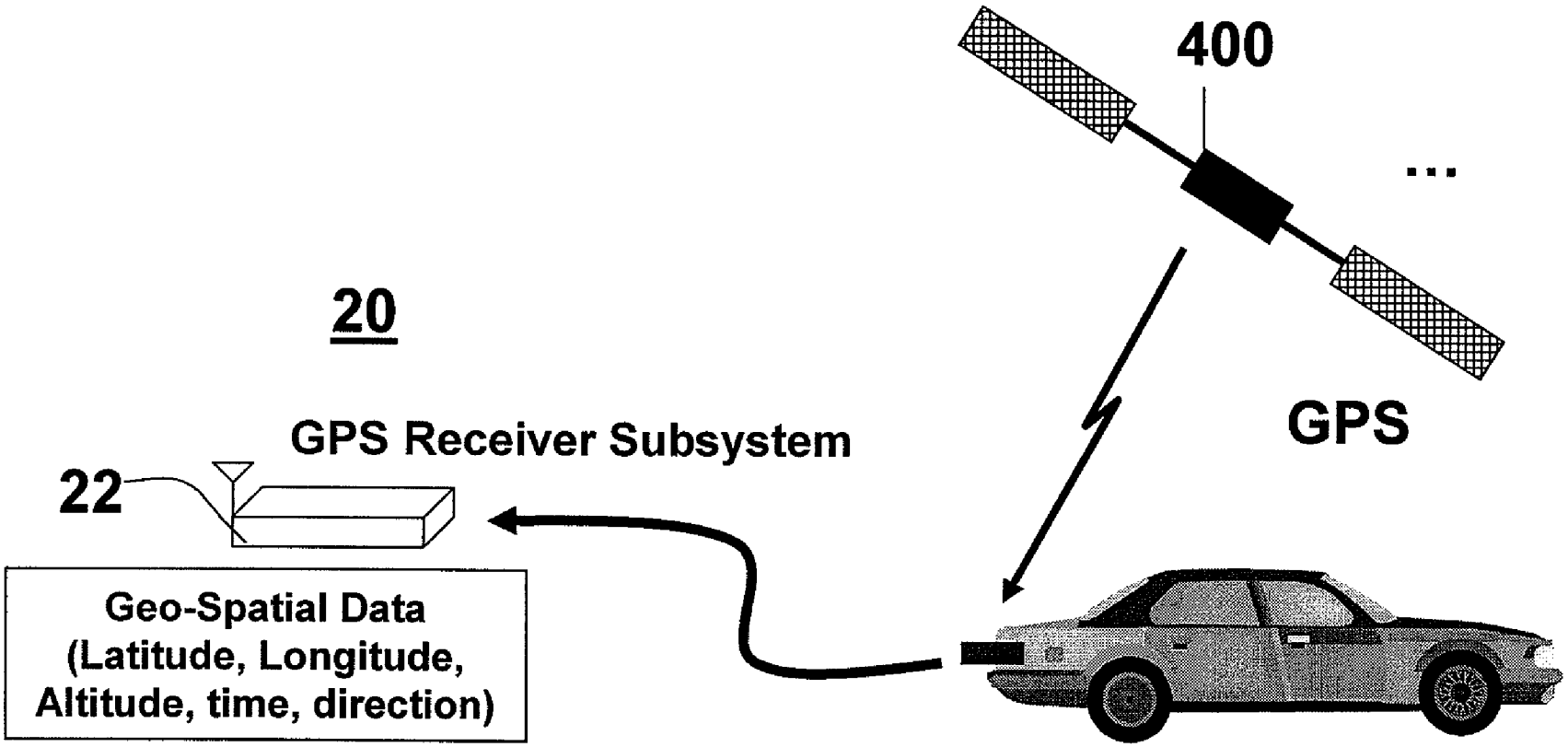
FIG. 5 is a diagram of the GPS receiver subsystem of the SDS according to an embodiment of the invention.

FIG. 5 illustrates the GPS subsystem 20 in greater detail. The GPS receiver subsystem 20 comprises a GPS receiver 22, which is well known in the art and commercially available. The GPS receiver 22 receives GPS signals from a group of GPS satellites shown at reference numeral 400. The GPS receiver 22 is used to tag data collected by the collection subsystem 10. A data request is made of the GPS receiver 22 when the collection subsystem 10 captures and records data that is passed to the collection processing subsystem 30 to be converted into a computer readable format. After the raw data is filtered or processed by the collection processing subsystem 30 and a computer readable format is determined, this data is tagged with the GPS information requested at the time of collection to create the UID 16 which is registered in the detection processing subsystem 40. This tagging function is important to the SDS 100 because it provides the necessary information (location, time, direction) needed for the TDD algorithms in determining whether a potential threat has been collected two or more times and the sightings are separated by time, distance, and direction.

Figure 6:
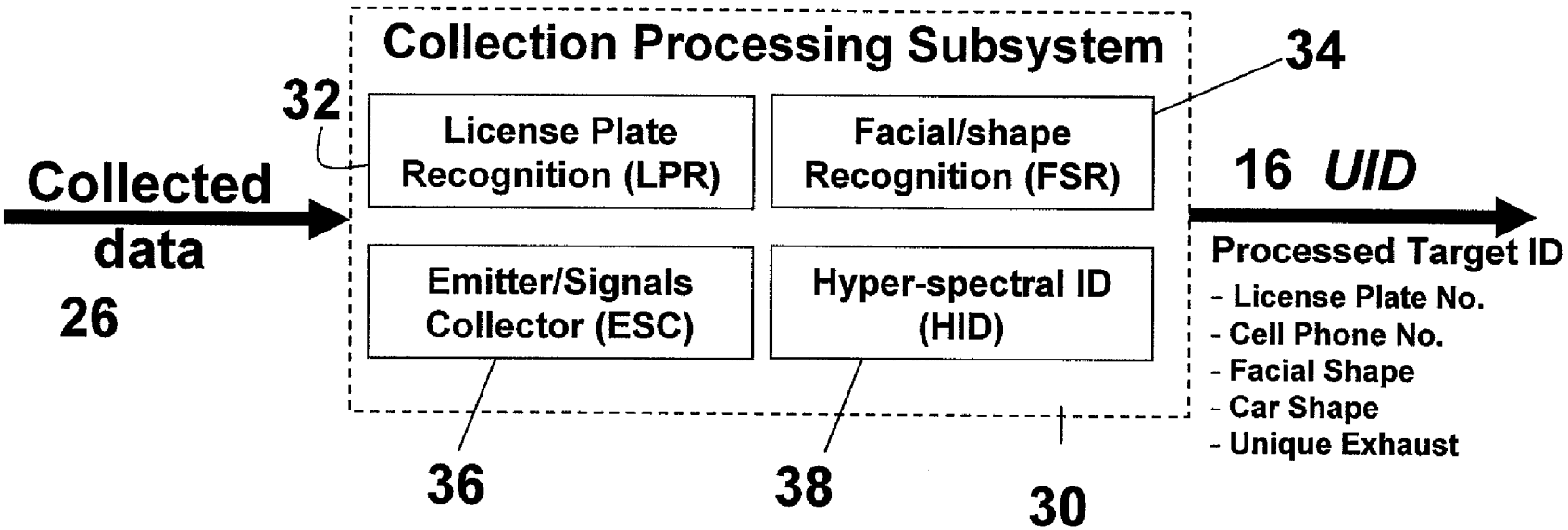
FIG. 6 is a diagram of the collection processing subsystem according to an embodiment of the invention.

FIG. 6 illustrates the collection processing subsystem 30 in further detail. The collection processing subsystem 30 is made up of processing algorithms or filters needed to translate collected information collected by the collection subsystem 10 into computer readable format (CRF). The CRF data is then tagged with GPS information (time, position and direction) to create the UID 16 that is analyzed by the detection processing subsystem 40. For example, the collection processing subsystem 30 executes a software-based license plate recognition (LPR) algorithm 32 on one or more digital still or video images obtained by the collection subsystem 10 to extract license plate information from the image(s). One process employed by the LPR algorithm 32 is to first determine a car's shape, estimate the position of the license plate on the car, and then interpret the letters in that portion of the digital image to "read" its license plate and translate the images into text for the detection processing algorithms to analyze (e.g., license plate ABC-1234). Image processing and analysis techniques to extract the license plate or other visible indicia of a car are well known in the art.

The collection processing subsystem 30 may also comprise software-based facial/shape recognition (FSR) algorithms 32 that analyze digital image data (still or video) to identify unique characteristics of a person's face or other visible portion. For the data collected that represent signals, the collection processing subsystem 30 may comprise emitter/signal collector (ESC) algorithms 36 that extract unique signal characteristics from detected signals, which characteristics can be used to determine whether surveillance is occurring by their very nature or by their occurrence over time, distance and direction. Likewise, there may be software-based hyperspectral ID algorithms 38 that are used to extract unique characteristics associated with remotely captured spectroscopy data obtained on a potential surveillant.

As a non-limiting example, the UID 16 may have the following information associated with it:

| UID | Time | Latitude (degrees) | Longitude (degrees) | Altitude (feet) | Direction |
|---|---|---|---|---|---|
| ABC-1234 | 1330 | 41.2 | −74.3 | 247 | NE |

While the UID in the above example is a license plate number, it should be understood that it may just as well be the shape of a face, a cell phone number or unique identifier (MAC address, IP address, TMSI, IMSI, etc.), wireless signal emission/transmission characteristic(s), beacon signal, unique exhaust characteristics, etc.

Figure 7:
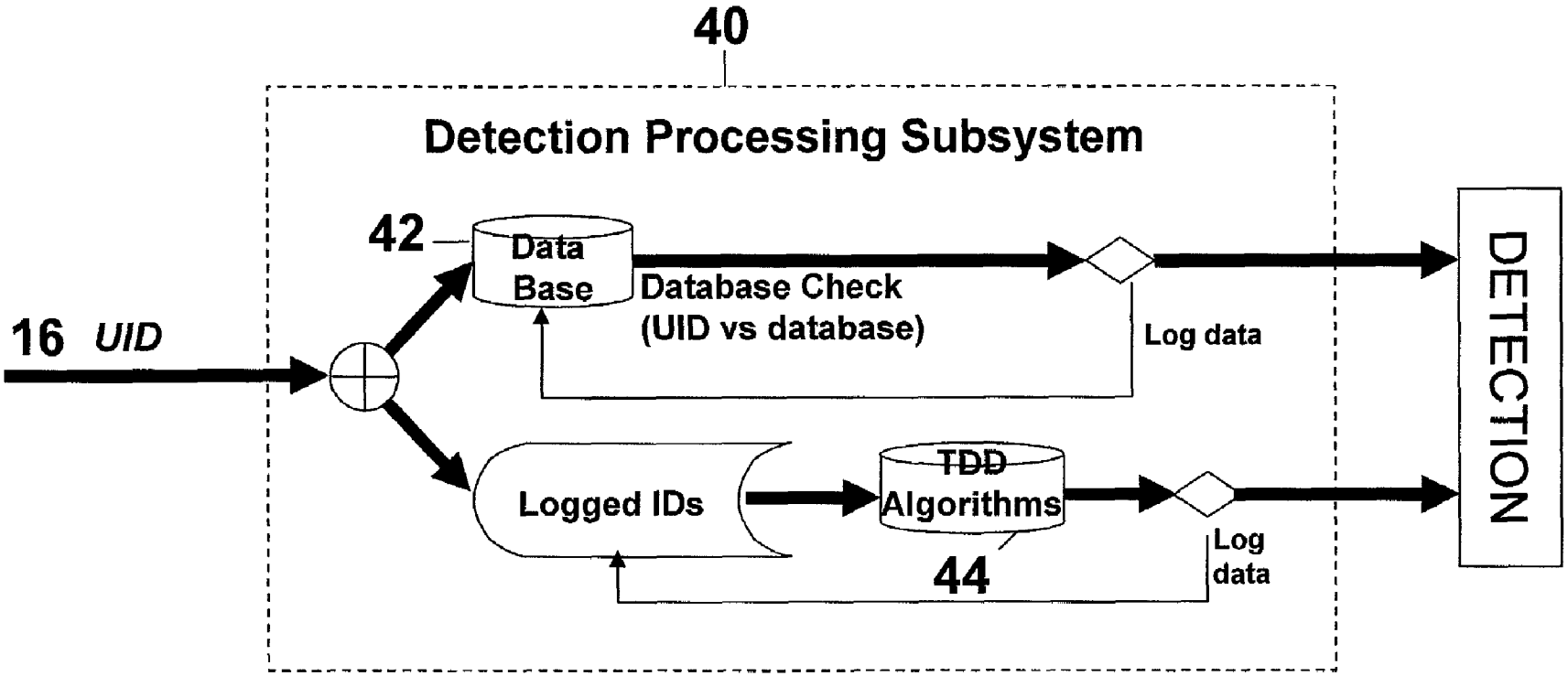
FIG. 7 is a diagram of the detection processing subsystem according to an embodiment of the invention.

Turning to FIG. 7, the detection processing subsystem 40 is described in further detail. As indicated above, the detection processing subsystem 40 analyzes UIDs 16 by two methods to determine if surveillance is present. One process labeled "Database Check" involves comparing the UID 16 data in a database maintained by a data storage device or system 42 to determine if the UID 16 is a confirmed or suspected threat based on data accumulated from prior encounters or other users of the SDS 100 in the same or other geographic regions. If the UID 16 matches surveillance threat data in the database (i.e., data associated with an a priori or otherwise known threat), the alarm subsystem 50 is activated. The data stored in database 42 may include any data associated with known surveillant threats such as license plate numbers, individual shapes, individual faces, mobile phone numbers, radio frequencies or other signal characteristics, or any of the types of information described herein or otherwise capable of uniquely identifying a surveillant or surveillance devices. As UIDs 16 are collected they are immediately checked against these known/stored threats. If the UID 16 is not in the database maintained in the data storage system 42, the UID 16 is stored for further processing.

The other method is a TDD algorithm 44 that analyzes UIDs supplied by the collection processing subsystem 30 to determine whether a UID has been detected twice during a user's route. If a UID is identified twice and the sightings are separated by a significant change in time, change in distance and change in direction, the detection processing subsystem 40 will activate the alarm subsystem 50. Thus, The TDD algorithm 44 analyzes the UIDs 16 for three distinct criteria: time, distance, and direction, each having a configurable threshold. These configurable thresholds are programmable based on the local environment and particular use of the individual employing the SDS 100. Experience and knowledge is used to set these thresholds appropriately based on the environment where SDS 100 is going to be used.

The time criterion involves determining whether the elapsed time between occurrences of the same UID within a configurable threshold or limit. This threshold is called the delta time threshold. For example, the same UID detected twice separated in time by 5 minutes would not be considered a threat since there had not been sufficient time between detections. However, detection of the same UID sighted twice separated in time by over 90 minutes (which is greater than the delta time threshold) may be considered suspicious and the TDD algorithm 44 would then examine the other parameters associated with those UID occurrences (change in distance and change in direction) to determine whether surveillance is present.

The second criterion or condition is sufficient change in distance. A configurable threshold is set for the change in distance and this threshold is called the delta distance threshold. For the second criterion to be satisfied, the change in distance between the same UID detections needs to exceed the delta distance threshold.

The third criterion or condition is sufficient change in direction. A configuration threshold is set for the change in direction and is called the delta direction threshold. The third criterion is satisfied when the change in direction between two or more same UID detections exceeds the delta direction threshold.

The delta thresholds associated with these criteria (time, distance, direction) are user configurable or programmable based on the user's local environment. For certain localities, such as congested urban areas, the thresholds may be set to different values than they would for more suburban or less congested areas, as an example. The above criteria (delta time, delta distance, delta direction) can be executed in any order and subset to support surveillance detection.

The geospatial data associated with each UID can be used to compute the road travel distance between two or more positions associated with the detection of the same UID. The TDD algorithm 44 may operate on geographically unique databases of information concerning the local environment. These databases include information about unique geographic and other variables based on the local setting such long distances, short distances, straight roads, windy roads, hilly, congestion during certain times of day, typical length and time of certain predetermined routes, terrain characteristics, road conditions, etc.

If all three thresholds are met, indicating that two or more detections of the same UID are sufficiently separated by a change in time, distance and direction, then the alarm subsystem 50 is activated. For example, at the beginning of a predetermined route the SDS 100 collects and stores information for detection of a vehicle with license plate "ABC-123" at location x1, y1, z1, at time t1 heading in a north east direction. After a predetermined period of time (corresponding to the delta time threshold), the TDD algorithm 44 will check recently collected UIDs versus UIDs collected previously during the route to check for duplicate sightings. If license plate ABC-1234 is collected a second time, at time t2, at location x2, y2, z2, heading in a new direction and there is sufficient time (delta threshold met), distance (delta distance threshold met), and direction (delta direction threshold met) separating the two detections (based on thresholds unique to the local environment), it will be considered a double sighting, recognized as a threat and the alarm subsystem will be activated.

Figure 8:
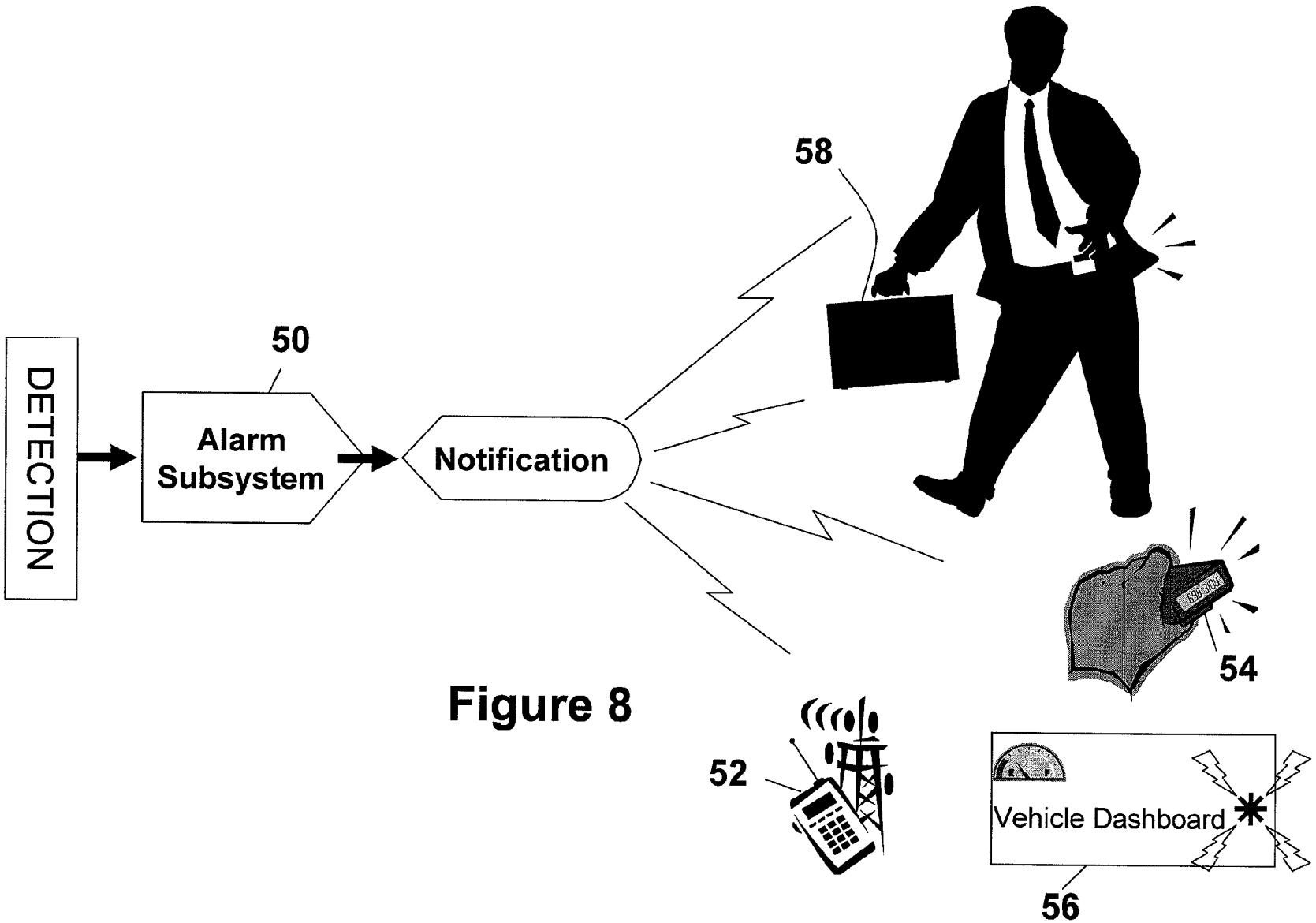
FIG. 8 is a diagram of the alarms subsystem according to an embodiment of the invention.

Reference is now made to FIG. 8 for a more detailed description of the alarm subsystem 50. The alarm subsystem 50 may comprise one or more of a variety of devices that can notify/alert/warn the user that surveillance has been detected. The warning may be transmitted by a secure wired or wireless signal method to, for example, a mobile wireless telephone or email device 52, a pager 54, a warning light 56 on a car dashboard or radio console, an audible device in a briefcase 58, etc. There are endless types of warning methods that can be designed or selected based on the user's location and lifestyle.

The SDS 100 can be deployed discreetly or in the open as a deterrent. There are many possible deployment platforms for the SDS 100, including, but not limited to, direct integration into a vehicle, briefcase, backpack, pocketbook, infant or child's seat, hand-held device such as a mobile wireless telephone and/or email device, portable data assistant (PDA), body-wearable device etc. Furthermore, the subsystems of the SDS 100 can either be fully integrated together or modular per subsystem based on the deployment requirements. For example, the collection subsystem may be integrated into a vehicle taillight and connected to the collection processing subsystem 30 that may also contain the GPS receiver subsystem 20. The collection processing subsystem 30 could send the UIDs 16 to a hand held device containing the detection processing subsystem algorithms that could have a self-contained alarm subsystem 50. The functions of the collection subsystem 10, collection processing subsystem 30, detection processing subsystem 40 and alarm subsystem 50 may be implemented by separate software modules executed on a single computer or processor or on several processors. It should be understood that these software modules would be stored in a memory medium and executed by a corresponding processor. Alternatively, the functions of some or all of these subsystems may be implemented in hardware, such as in one or several application integrated circuits or embedded system-on-chip platforms.

To summarize, a method is provided for automatically detecting that an individual is under surveillance, comprising detecting at least one uniquely identifying characteristic (or a collected set of variables when combined that make up a uniquely identifiable set) associated with a vehicle or a person in proximity to said individual as said individual moves about a geographic region; detecting a position in said geographic region where the uniquely identifying characteristics are detected as said individual moves about said geographic region and times when the detections or collections of the uniquely identifying characteristics are made; storing data for detections of said uniquely identifying characteristics, positions where said uniquely identifying characteristics are detected and times when the detections are made as said individual moves about said geographic region; and analyzing said data to determine whether said individual is under surveillance based on at least two detections of the same uniquely identifying characteristics sufficiently separated by time, distance and direction as said individual moves about said geographic region.

Similarly, a system is provided for detecting that an individual is under surveillance, comprising at least one sensor device that detects data that comprises at least one uniquely identifying characteristic associated with a vehicle or a person in proximity to said individual and outputs data representative thereof; a positioning receiver device that receives signals from several sources and from which signals it computes a position of said individual and outputs data representative thereof and of times where said at least one uniquely identifying characteristic is detected; and a control processor coupled to said at least one sensor device and said positioning receiver device that stores data output by said at least one sensor device for vehicles or persons in proximity to said individual as said individual moves about a geographic region together with data output by said positioning receiver device that indicates positions in said geographic region where said sensor device detects uniquely identifying characteristics for vehicles or persons in vehicles as said individual moves about said geographic region, and wherein said control processor analyzes the stored data to determine whether said individual is under surveillance based on at least two detections of the same uniquely identifying characteristics sufficiently separated by time, distance and direction as said individual moves about said geographic region.

Still further, a computer readable medium encoded with instructions that, when executed by a computer processor, cause said processor to perform functions comprising: storing data for detections of uniquely identifying characteristics associated with a vehicle or person in proximity to an individual, positions where said uniquely identifying characteristics are detected and times when the detections are made as said individual moves about a geographic region; and analyzing said data to determine whether said individual is under surveillance based on at least two detections of the same uniquely identifying characteristics sufficiently separated by time, distance and direction as said individual moves about said geographic region.

Further yet, a system is provided for detecting that an individual is under surveillance, comprising: a first subsystem that detects data pertaining to vehicles or persons in proximity to said individual as said individual moves around a geographic region; a second subsystem coupled to the first subsystem that processes said data to generate uniquely identifying characteristics associated the vehicles or persons in proximity to said individual as said individual moves around a geographic region; a third subsystem that determines a position within said geographic region and times associated with detections of said uniquely identifying characteristics; and a fourth subsystem coupled to the second subsystem and third subsystem, wherein the fourth subsystem stores data for said uniquely identifying characteristics together with the times and positions associated with detections of said uniquely identifying characteristics are detected; and a fifth subsystem that is coupled to the fourth subsystem and that analyzes the data stored by the fourth subsystem to determine whether said individual is under surveillance based on at least two detections of the same uniquely identifying characteristics sufficiently separated by time, distance and direction as said individual moves about said geographic region.

Further, a system for detecting that an individual is under surveillance, comprising means for detecting at least one uniquely identifying characteristic associated with a vehicle or a person in proximity to said individual as said individual moves about a geographic region; means for detecting a position in said geographic region where the uniquely identifying characteristics are detected and times of detection as said individual moves about said geographic region; means for storing data for detections of said uniquely identifying characteristics, positions where said uniquely identifying characteristics are detected and times when detections are made as said individual moves about said geographic region; and means for analyzing said data to determine whether said individual is under surveillance based on at least two detections of the same uniquely identifying characteristics sufficiently separated by time, distance and direction as said individual moves about said geographic region.

It should be understood that there may be applications for the SDS and methodology described herein in which a surveillance condition is declared based on (1) a match of the uniquely identifying characteristics with data stored in a database of known surveillance threats (vehicles, individuals or other characteristics) without regard to the time, distance and direction parameters associated with detection of those uniquely identifying characteristics, or (2) at least two detections of the same uniquely identifying characteristics sufficiently separated by time, distance and direction as said individual moves about said geographic region; or (3) based on either (1) or (2), and in particular the declaration and alert of surveillance may be made immediately when the conditions or (1) occur without necessarily waiting to determine if the conditions or (2) are met.

The system and methods described herein may be embodied in other specific forms without departing from the spirit or essential characteristics thereof. The foregoing embodiments are therefore to be considered in all respects illustrative and not meant to be limiting.

What is claimed is:

1. A system for detecting that an individual is under surveillance, comprising:

a. at least one sensor device that detects data that comprises at least one uniquely identifying characteristics associated with a vehicle or a person in proximity to said individual and outputs data representative thereof;

b. a positioning receiver device that receives signals from several sources and from which signals it computes a position of said individual and outputs data representative thereof and of times where said at least one uniquely identifying characteristics is detected; and c. a control processor coupled to said at least one sensor device and said positioning receive device that stores data output by said at least one sensor device for vehicles or persons in proximity to said individual as said individual moves about a geographic region together with data output by said positioning receiver device that indicates positions in said geographic region where said sensor device detects uniquely identifying characteristics for vehicles or persons in vehicles as said individual moves about said geographic region, and wherein said control processor analyzes the stored data to determine whether said individual is under surveillance based on at least two detections of the same uniquely identifying characteristics sufficiently separated by time, distance and direction as said individual moves about said geographic region.

2. The system of claim 1, wherein said control processor generates a signal indicating that the individual is under surveillance when it is determined that at least two detections of the same uniquely identifying characteristics are separated in time by at least a first threshold, separated in distance by at least a second threshold and different in direction by at least a third threshold.

3. The system of claim 1, wherein said at least one sensor device comprises a camera device that captures still or video images of vehicles or persons in proximity to said individual.

4. The system of claim 3, wherein said control processor processes said images to extract a portion thereof containing one or more alphanumeric characters on a license plate of a vehicle in proximity to said individual, where said alphanumeric characters on the license plate correspond to said uniquely identifying characteristics.

5. The system of claim 1, wherein said at least one sensor device comprises one or more of: a camera device that captures still or video images of vehicles or persons in proximity to said individual to produce image data of a person or vehicle as said uniquely identifying characteristic; a receiver that receives over-the-air signal transmission or emissions from a device on a person or vehicle in proximity to said individual to produce received signal data as said uniquely identifying characteristic; radar monitoring equipment that transmits signals and receives reflected signals back from objects or persons in proximity to said individual to produce radar data as said uniquely identifying characteristic; remote spectroscopy monitoring equipment that emits optical energy and analyzes reflected or scattered optical energy to produce spectroscopy data as said uniquely identifying characteristic; infrared monitoring equipment that produces infrared imaging data as said uniquely identifying characteristic; laser radar monitoring equipment to produce laser radar data as said uniquely identifying characteristic; synthetic aperture radio monitoring equipment to produce synthetic aperture radar data as said uniquely identifying characteristic; and signal processing equipment that recovers a unique identifier from a transmission made by a communication device.

6. The system of claim 1, wherein said control processor compares said data for said uniquely identifying characteristics against data stored in a database associated with a vehicle or person known or suspected to be involved in conducting surveillance, and generates an output indicating that the individual is under surveillance when either there is a match between any uniquely identifying characteristics collected with information contained in said database or when at least two detections are made of the same uniquely identifying characteristics sufficiently separated by time, distance and direction as said individual moves about said geographic region.

7. The system of claim 1, and further comprising an alarm device coupled to said control processor, wherein said control processor generates a command to activate said alarm device to generate one or more of an audible, visual or tactile alert to said individual when the control processor determines that the individual is under surveillance.

8. The system of claim 1, wherein said positioning receiver device is a global positioning system (GPS) receiver that receives signals from GPS satellites and produces position information comprising time, latitude, longitude and direction.

9. The system of claim 1, wherein one or more of the at least one sensor device, positioning receiver device and control processor are mounted in a vehicle.

10. The system of claim 1, wherein one or more of the at least one sensor device, positioning receiver device and control processor are in a hand-held device.

11. A method for automatically detecting that an individual is under surveillance, comprising:

a. detecting at least one uniquely identifying characteristic associated with a vehicle or a person in proximity to said individual as said individual moves about a geographic region;

b. detecting a position in said geographic region where the uniquely identifying characteristics are detected as said individual moves about said geographic region and times when the detections are made;

c. storing data for detections of said uniquely identifying characteristics, positions where said uniquely identifying characteristics are detected and times when detections are made as said individual moves about said geographic region; and d. analyzing said data to determine whether said individual is under surveillance based on at least two detections of the same uniquely identifying characteristics sufficiently separated by time, distance and direction as said individual moves about said geographic region.

12. The method of claim 11, and wherein (d) analyzing comprises declaring that the individual is under surveillance when at least two detections of the same uniquely identifying characteristics are separated in time be a least a first threshold, separated in distance by at least a second threshold and different in direction by at least a third threshold.

13. The method of claim 11, wherein (b) detecting position comprises receiving global positioning system (GPS) signals and deriving the time and position where detection of said uniquely identifying characteristics are made from said GPS signals.

14. The method of claim 11, and further comprising comparing data for said stored uniquely identifying characteristics against data associated with a vehicle or person known or suspected to be involved in conducting surveillance such that a determination is made that the individual is under surveillance when there is either a match of said uniquely identifying characteristics with data for known surveillance threats or based on at least two detections of the same uniquely identifying characteristics sufficiently separated by time, distance and direction as said individual moves about said geographic region.

15. The method of claim 11, and further comprising generating activating a warning alert to said individual comprising one or more of: an audible alert, a visual alert, and tactile alert when it is determined that the individual is under surveillance.

16. The method of claim 11, wherein (a) detecting comprises capturing still or video images of vehicles or persons in proximity to said individual as said individual moves about said geographic region.

17. The method of claim 16, and further comprising analyzing said images to extract a portion thereof containing one or more alphanumeric characters on a license plate of a vehicle in proximity to said individual, wherein said alphanumeric characters on the license plate correspond to said uniquely identifying characteristics.

18. The method of claim 11, wherein detecting comprises one or more of:

capturing still or video images of vehicles or persons in proximity to said individual to produce image data of a person or vehicle as said uniquely identifying characteristic; receiving over-the-air signal transmissions or emissions from a device on a person or vehicle in proximity to said individual to produce received signal data as said uniquely identifying characteristic;

receiving radar signals reflected back from objects or persons in proximity to said individual to produce radar data as said uniquely identifying characteristic;

receiving optical energy scattered by a vehicle or person in proximity to said individual to produce spectroscopy data as said uniquely identifying characteristic;

receiving infrared energy emitted by a vehicle or person in proximity to said individual as said uniquely identifying characteristic; and recovering a unique identifiers from a transmission made from a communication device as said uniquely identifying characteristic.

19. A computer readable medium encoded with instructions that, when executed by a computer processor, cause said processor to perform functions comprising:

a. storing data for detections of uniquely identifying characteristics associated with a vehicle or person in proximity to an individual, positions where said uniquely identifying characteristics are detected and times when detections are made as said individual moves about a geographic region; and b. analyzing said data to determine whether said individual is under surveillance based on at least two detections of the same uniquely identifying characteristics sufficiently separated by time, distance and direction as said individual moves about said geographic region.

20. The computer readable medium of claim 19, wherein said instructions for performing the function of analyzing comprise instructions for determine that said individual is under surveillance based on either a match of said uniquely identifying characteristics with data for known surveillance threats or based on at least two detections of the same uniquely identifying characteristics sufficiently separated by time, distance and direction as said individual moves about said geographic region.

21. A system for detecting that an individual is under surveillance, comprising:

a. a first subsystem that collects data pertaining to vehicles or persons in proximity to said individual as said individual moves around a geographic region;

b. a second subsystem coupled to the first subsystem that processes said data to generate uniquely identifying characteristics associated the vehicles or persons in proximity to said individual as said individual moves around a geographic region;

c. a third subsystem that determines a position within said geographic region and times associated with detection of said uniquely identifying characteristics; and d. a fourth subsystem coupled to the second subsystem and third subsystem, wherein the fourth subsystem stores data for said uniquely identifying characteristics together with the time and positions associated with detections of said uniquely identifying characteristics are detected; and e. a fifth subsystem that is coupled to the fourth subsystem and that analyzes the data stored by the fourth subsystem to determine whether said individual is under surveillance based on either a match of said uniquely identifying characteristics with data for known surveillance threats or based on at least two detections of the same uniquely identifying characteristics sufficiently separated by time, distance and direction as said individual moves about said geographic region.

22. A system for detecting that an individual is under surveillance, comprising:

a. means for detecting at least one uniquely identifying characteristic associated with a vehicle or a person in proximity to said individual as said individual moves about a geographic region;

b. means for detecting a position in said geographic region where the uniquely identifying characteristics are detected and times of detection as said individual moves about said geographic region;

c. means for storing data for detections of said uniquely identifying characteristics, positions where said uniquely identifying characteristics are detected and time when detections are made as said individual moves about said geographic region; and d. means for analyzing said data to determine whether said individual is under surveillance based on either a match of said uniquely identifying characteristics with data for known surveillance threats or based on at least two detections of the same uniquely identifying characteristics sufficiently separated by time, distance and direction as said individual moves about said geographic region.

23. A method for automatically detecting that an individual is under surveillance, comprising:

a. detecting at least one uniquely identifying characteristic associated with a vehicle or a person in proximity to said individual as said individual moves about a geographic region;

b. detecting a position in said geographic region where the uniquely identifying characteristics are detected as said individual moves about said geographic region and times when the detections are made;

c. storing data for detections of said uniquely identifying characteristics, positions where said uniquely identifying characteristics are detected and time when detections are made as said individual moves about said geographic region; and d. analyzing said data to determine whether said individual is under surveillance based on a match of said uniquely identifying characteristics with stored data for known surveillance threats, wherein said analyzing comprises analyzing said data to determine whether said individual is under surveillance based on either a match of said uniquely identifying characteristics with data for known surveillance threats or based on at least two detection of the same uniquely identifying characteristics sufficiently separated by time, distance and direction as said individual moves about said geographic region.

* * * * *